US008496341B2

(12) United States Patent
Kawata et al.

(10) Patent No.: US 8,496,341 B2
(45) Date of Patent: Jul. 30, 2013

(54) LIGHTING DEVICE

(75) Inventors: Takuya Kawata, Kanagawa (JP); Yutaka Uchida, Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 117 days.

(21) Appl. No.: 13/242,674

(22) Filed: Sep. 23, 2011

(65) Prior Publication Data

US 2012/0087134 A1 Apr. 12, 2012

(30) Foreign Application Priority Data

Oct. 7, 2010 (JP) ..... 2010-227849

(51) Int. Cl.
*F21V 9/16* (2006.01)

(52) U.S. Cl.
USPC ..... 362/84; 362/231

(58) Field of Classification Search
USPC ..... 362/84, 146, 650, 231
See application file for complete search history.

(56) References Cited

U.S. PATENT DOCUMENTS

| | | | | |
|---|---|---|---|---|
| 6,171,117 | B1 * | 1/2001 | Chien | 362/84 |
| 6,274,887 | B1 | 8/2001 | Yamazaki et al. | |
| 6,847,163 | B1 | 1/2005 | Tsutsui et al. | |
| 7,202,504 | B2 | 4/2007 | Ikeda et al. | |
| 7,473,928 | B1 | 1/2009 | Yamazaki et al. | |
| 7,554,263 | B2 | 6/2009 | Takahashi | |
| 7,692,199 | B2 | 4/2010 | Arai | |
| 7,859,627 | B2 | 12/2010 | Nishida et al. | |
| 7,956,349 | B2 | 6/2011 | Tsutsui et al. | |
| 2001/0019242 | A1 * | 9/2001 | Tada et al. | 313/504 |
| 2008/0129933 | A1 | 6/2008 | Nishida et al. | |
| 2010/0006882 | A1 | 1/2010 | Arai | |

FOREIGN PATENT DOCUMENTS

JP 2005-332773 12/2005

* cited by examiner

*Primary Examiner* — David V Bruce
(74) *Attorney, Agent, or Firm* — Nixon Peabody LLP; Jeffrey L. Costellia

(57) ABSTRACT

One object is to reduce the weight of a lighting device including an electroluminescent material. An object is to achieve high reliability of a lighting device including an electroluminescent material. In a lighting device including a light-emitting element having an electroluminescence (EL) layer, a housing formed using an organic resin whose refractive index is greater than or equal to that of the EL layer is provided to cover a light emission surface and a top surface of the light-emitting element. In addition, an inorganic insulating film covering an inner wall of the housing provided with the light-emitting element and the top surface of the light-emitting element is preferably provided.

10 Claims, 10 Drawing Sheets

LIGHTING DEVICE

BACKGROUND OF THE INVENTION

1. Field of the Invention

One embodiment of the present invention relates to a lighting device including a light-emitting member which exhibits electroluminescence.

2. Description of the Related Art

As a next-generation lighting device, a lighting device using an electroluminescent material has attracted attention because its emission efficiency is estimated to be higher than that of filament bulbs or fluorescent bulbs. A thin film of an electroluminescent material can be formed to a thickness of 1 μm or less by vapor deposition or coating, and the structure of such a lighting device has been devised; for example, some inventions disclose a lighting device using an electroluminescent material in which the uniformity of the luminance is kept constant even when the area of the lighting device is increased (for example, see Patent Document 1).

REFERENCE

[Patent Document 1] Japanese Published Patent Application No. 2005-332773

SUMMARY OF THE INVENTION

One object of one embodiment of the present invention is to reduce the weight of a lighting device including an electroluminescent material. Another object of one embodiment of the present invention is to achieve high reliability of a lighting device including an electroluminescent material.

In a lighting device including a light-emitting element having an electroluminescence (EL) layer, a housing formed using an organic resin whose refractive index is greater than or equal to that of the EL layer is provided to cover a light emission surface and a top surface of the light-emitting element.

One embodiment of the present invention includes a light-emitting element including an EL layer that is sandwiched between a first electrode and a second electrode, and a housing which is formed using a light-transmitting organic resin whose refractive index is greater than or equal to that of the EL layer, and covers a light emission surface and a top surface of the light-emitting element. At least one of the first electrode and the second electrode is provided for the light emission surface of the light-emitting element and has a light-transmitting property. Note that in this specification, a light-transmitting property means a property to transmit light at least in a wavelength range of visible light.

Another embodiment of the present invention includes a light-emitting element including an EL layer that is sandwiched between a first electrode and a second electrode, a first housing covering a light emission surface of the light-emitting element, and a second housing covering a top surface of the light-emitting element. At least one of the first electrode and the second electrode is provided for the light-emission surface of the light-emitting element and has a light-transmitting property; the first housing and the second housing each have a refractive index greater than or equal to a refractive index of the EL layer; and the first housing and the second housing are attached to each other to seal the light-emitting element.

A refractive index of the organic resin used for the housing which is provided to cover the light-emitting element is preferably greater than or equal to 1.7 and less than or equal to 1.8.

When an organic resin whose refractive index is equal to or greater than that of the EL layer is used for the housing covering the EL layer, reflection of light emitted from the EL layer at the interface between the light-emitting element and the housing can be reduced.

In addition, it is preferable that an inorganic insulating film which covers the top surface of the light-emitting element and an inner wall of the housing which is provided to cover the light-emitting element be provided. In addition, an inorganic insulating film may also be provided between the light emission surface of the light-emitting element and the housing. The inorganic insulating film serves as a sealing film or a protective layer which blocks an external contaminant such as water. As the inorganic insulating film, a single layer or a stacked layer of a nitride film and a nitride oxide film can be used. By providing the inorganic insulating film, degradation of the light-emitting element can be reduced and the durability and the lifetime of the lighting device can be improved.

The shape of the emission surface of the light-emitting element may be a polygon such as a quadrangle or a circle, and the shape of the housing (the first housing) covering the emission surface may correspond to the shape of the emission surface.

In addition, two or more EL layers may be provided with an intermediate layer provided therebetween. By stacking a plurality of EL layers having different emission colors, the color of the emitted light can be adjusted. In addition, even when a plurality of EL layers which emit the same color are provided, power efficiency of the light-emitting element can be improved.

Since an organic resin is used for the housing covering the EL layer in the lighting device of this embodiment, reduction in the weight of the lighting device can be achieved. In addition, since an organic resin whose refractive index is equal to or greater than that of the EL layer is used for the housing, reflection of the light emitted from the EL layer at the interface between the light-emitting element and the housing can be reduced. Further, since the lighting device according to one embodiment of the present invention has a structure in which degradation of an element is not easily caused, a long-lifetime lighting device can be provided. Accordingly, high reliability can be achieved in the lighting device that is one embodiment of the present invention.

DETAILED DESCRIPTION OF THE INVENTION

Figure 1:
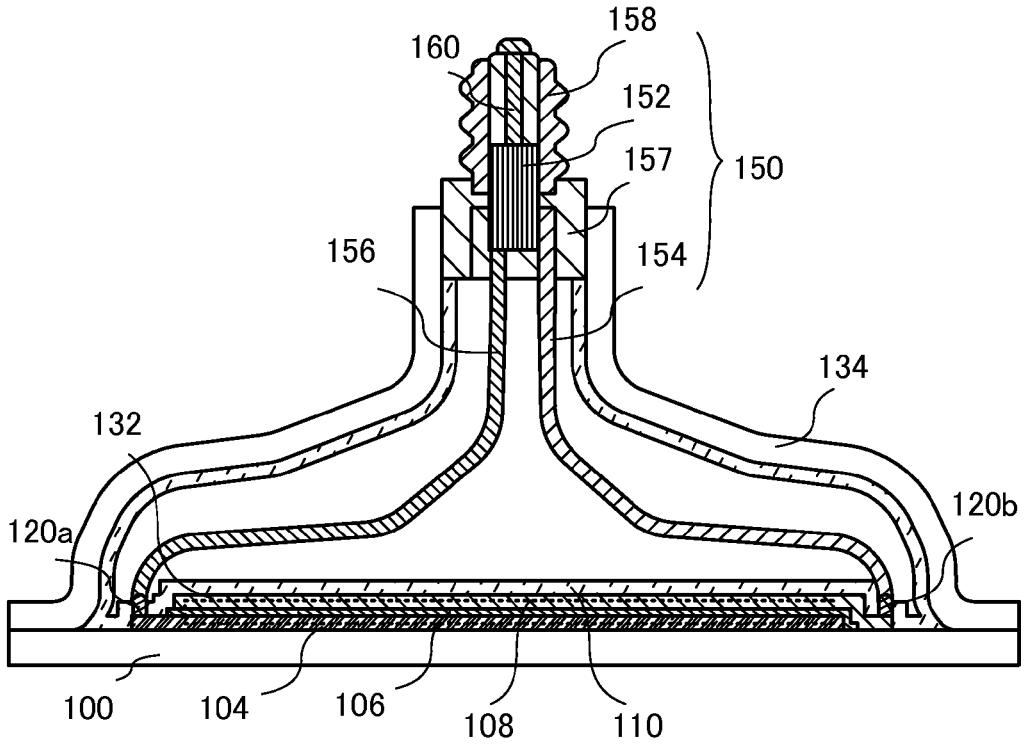
FIG. 1 is a cross-sectional view illustrating a lighting device.

Embodiments will be described in detail with reference to the drawings. Note that the present invention is not limited to the following description, and it will be easily understood by those skilled in the art that various changes and modifications can be made without departing from the spirit and scope of the present invention. Therefore, the present invention should not be construed as being limited to the following description of the embodiments. In the structures to be given below, the same portions or portions having similar functions are denoted by the same reference numerals in different drawings, and explanation thereof will not be repeated.

Embodiment 1

In this embodiment, one embodiment of a lighting device of the present invention will be described with reference to FIG. 1, FIG. 2, FIG. 3, FIGS. 4A to 4D, FIGS. 5A and 5B, and FIGS. 6A and 6B.

FIG. 1, FIG. 2, FIG. 3, FIGS. 4A to 4D, FIGS. 5A and 5B, and FIGS. 6A and 6B are cross-sectional views of lighting devices. FIGS. 4A to 4D and FIGS. 5A and 5B illustrate a method for manufacturing the lighting device.

A lighting device illustrated in FIG. 1 has a structure in which a housing (a first housing 100 and a second housing 134) which is formed using an organic resin whose refractive index is greater than or equal to that of an EL layer 106 is provided to cover a light emission surface and a top surface of a light-emitting element 132 including the EL layer 106.

The light-emitting element 132 includes a first electrode 104, the EL layer 106, and a second electrode 108. Light is emitted from the EL layer 106 to the outside through the first electrode 104 and the first housing 100, and thus a surface on the first electrode 104 side is the light emission surface. Accordingly, the first electrode 104 and the first housing 100 have at least a property of transmitting light from the EL layer 106.

The refractive index of the organic resin used for the first housing 100 and the second housing 134 which are provided to cover the light-emitting element 132 is preferably greater than or equal to 1.7 and less than or equal to 1.8. When an organic resin whose refractive index is equal to or greater than that of the EL layer 106 is used for the housing covering the EL layer, light reflection at an interface between the light-emitting element 132 and the first housing 100 can be reduced.

Figure 2:
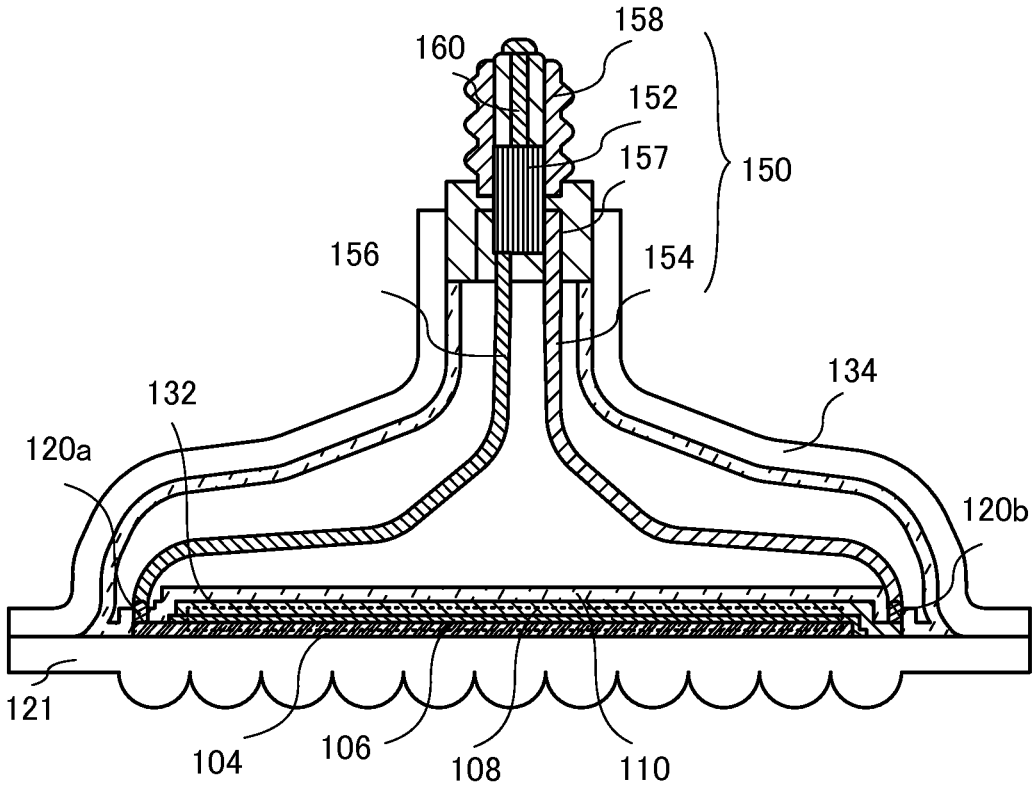
FIG. 2 is a cross-sectional view illustrating a lighting device.

Further, as illustrated in FIG. 2, in the housing (the first housing) which is provided to cover the light emission surface of the light-emitting element 132, a plurality of projections and depressions like a micro lens array may be provided on (a surface of) the side opposite to the light-emitting element 132. With the plurality of projections and depressions, the efficiency of extraction of light to the outside of the housing can be improved.

In the case of the light-emitting element including the organic EL layer which generates less heat as compared to a light-emitting element using a light-emitting diode (LED), an organic resin can be used as the housing; thus reduction in the weight of the lighting device is possible.

Further, in the case where the two housings are attached to be used as the housing covering the light emission surface and the top surface of the light-emitting element as illustrated in FIG. 1, the same organic resin is used for the first housing 100 and the second housing 134. When the same organic resin is used for the first housing 100 and the second housing 134, and the first housing 100 and the second housing 134 are attached to each other to form the housing, a defect in shape due to thermal strain or physical impact hardly occurs. Accordingly, damages to the lighting device at the time of manufacture or use can be reduced.

In the case where a thermoplastic organic resin is used for the first housing 100 and the second housing 134, the first housing 100 and the second housing 134 can be attached to each other by thermocompression bonding. Further, the first housing 100 and the second housing 134 may be attached to each other by providing an attachment layer therebetween. As the attachment layer, a visible light curing resin, an ultraviolet curing resin, or a thermosetting resin can be used. In the case where the attachment layer is used, the same organic resin material as the first housing 100 and the second housing 134 is also preferably used for the attachment layer because resistance to damages is increased as described above.

Figure 3:
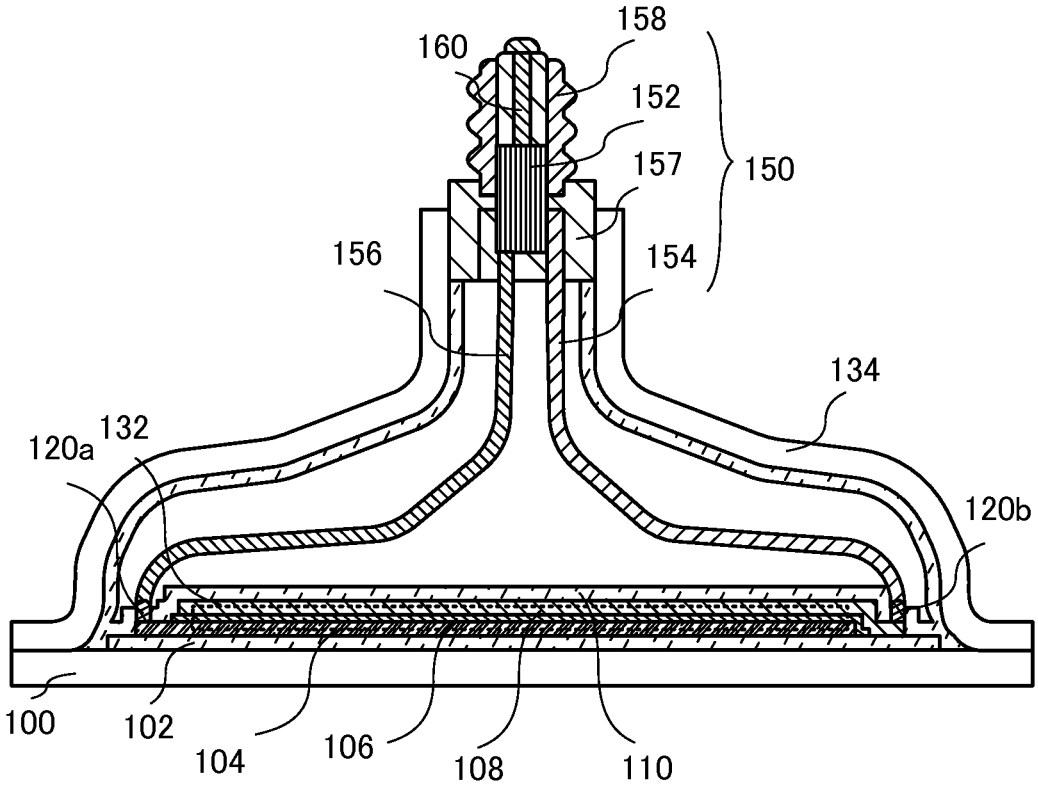
FIG. 3 is a cross-sectional view illustrating a lighting device.

Further, an inorganic insulating film 110 covering the inner wall of the housing (in particular, the second housing 134) which is provided to cover the light-emitting element 132 and the top surface of the light-emitting element 132 is preferably provided. In addition, as illustrated in FIG. 3, an inorganic insulating film 102 may be provided between the light emission surface of the light-emitting element 132 and the first housing 100. The inorganic insulating films 102 and 110 function as sealing films or protective layers which block an external contaminant such as water. By providing the inorganic insulating films, degradation of the light-emitting element is reduced and the durability and the lifetime of the lighting device can be improved.

As each of the inorganic insulating films 102 and 110, a single layer or a stacked layer using a nitride film and a nitride oxide film can be used. Specifically, the inorganic insulating films 102 and 110 can be formed with the use of silicon oxide, silicon nitride, silicon oxynitride, aluminum oxide, aluminum nitride, aluminum oxynitride, or the like by a chemical vapor deposition (CVD) method, a sputtering method, or the like in accordance with the material. The inorganic insulating films 102 and 110 are preferably formed with the use of silicon nitride by a CVD method. The thickness of each of the inorganic insulating films 102 and 110 may be approximately 100 nm to 1 μm.

Alternatively, as each of the inorganic insulating films 102 and 110, a diamond like carbon (DLC) film, a carbon film containing nitrogen, a film containing zinc sulfide and silicon oxide (a $ZnS.SiO_2$ film), or the like may be used.

The shape of the emission surface of the light-emitting element 132 may be a polygon such as a quadrangle or a circle, and the shape of the housing (the first housing 100) covering the emission surface may correspond to the shape of the emission surface.

As a specific example of a material used for the first housing 100, an organic resin (plastic) can be given. As an example of plastic, a material formed from polycarbonate, polyarylate, polyethersulfone, or the like can be given.

The size of the first housing 100 can be set as appropriate depending on the usage of the lighting device. For example, a circular shape with a diameter of 10 cm to 14 cm, preferably 12 cm, or a square shape with 5 inches square may be employed.

Further, a connection member 150 (also referred to as a base) which is connected to an external power source is provided in the lighting device.

The connection member 150 is provided above the light-emitting element 132 and in an opening which is provided in the second housing 134. Accordingly, part of the inorganic insulating film 110 in the vicinity of the opening of the second housing 134 in which the connection member 150 is provided is removed, in order to improve adhesion and hermeticity.

The connection member 150 includes a control circuit 152, a first connection wiring 156, a second connection wiring 154, a first extraction wiring 160, and a second extraction wiring 158. The diameter of the connection member 150 may be 10 mm to 40 mm, typically approximately 25 mm.

Figure 6A:
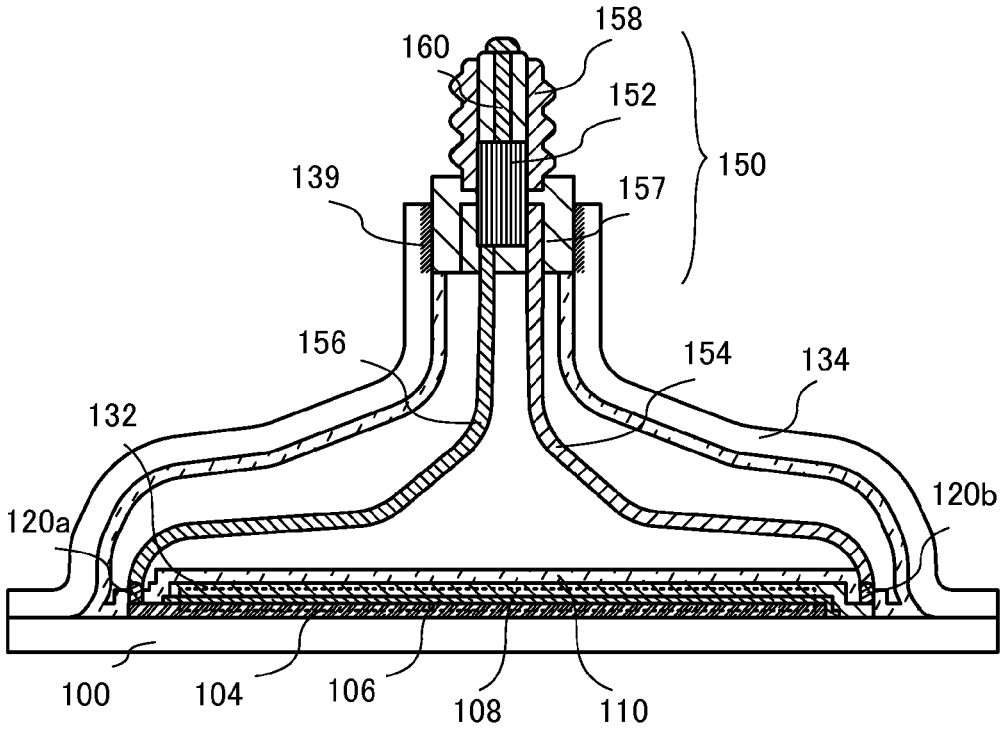
FIGS. 6A and 6B are cross-sectional views illustrating a lighting device.
Figure 6B:
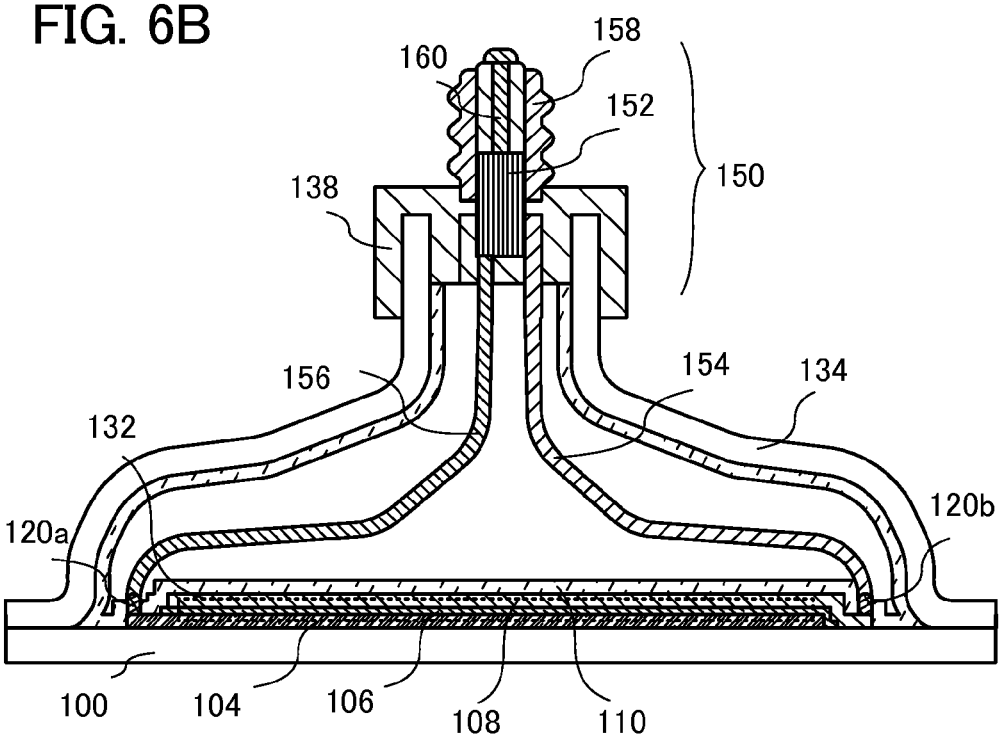

The connection member 150 is provided so as to be inserted in the opening of the second housing 134. The connection member 150 may be provided so as to be screwed into the second housing 134, and equipment for fixing a portion where the second housing 134 is in contact with the connection member 150 may be provided to improve fixing strength. In order to improve the effects of sealing and encapsulation, as illustrated in FIG. 6A, treatment may be performed so that the vicinity of the opening of the second housing 134 has a rough surface and an uneven shape 139 is provided. Alternatively, as illustrated in FIG. 6B, an insulating member 138 may be provided in the connection member 150 so as to cover the opening of the second housing 134 to improve hermeticity and adhesion.

The first electrode 104 of the light-emitting element 132 is electrically connected to the first extraction wiring 160 via a conductive layer 120*a*, the first connection wiring 156, and the control circuit 152. The second electrode 108 of the light-emitting element 132 is electrically connected to the second extraction wiring 158 via the conductive layer 120*b*, the second connection wiring 154, and the control circuit 152. The connection member 150 is connected to the external power source, whereby the lighting device can be supplied with power from the external power source and be turned on. Note that the conductive layers 120*a* and 120*b* are formed in openings which are provided in the inorganic insulating film 110 and reach the first electrode 104 and the second electrode 108.

For example, the control circuit 152 has a function of making the light-emitting element 132 emit light with a constant luminance with the use of a power supply voltage supplied from the external power source. For example, an alternating-current voltage of 100 V (110 V) supplied from the external power source is converted into a direct-current (DC) voltage of 5V to 10V by a converter in the control circuit 152.

The control circuit 152 includes, for example, a rectifying and smoothing circuit, a constant voltage circuit, and a constant current circuit. The rectifying and smoothing circuit is a circuit for converting an alternating-current voltage supplied from an external alternating-current power source into a direct-current voltage. The rectifying and smoothing circuit may be formed by, for example, a combination of a diode bridge circuit, a smoothing capacitor, and the like. The constant voltage circuit is a circuit for stabilizing the direct-current voltage having ripples output from the rectifying and smoothing circuit and outputting a constant voltage. The constant voltage circuit may be formed by a switching regulator, a series regulator, or the like. The constant current circuit is a circuit for outputting a constant current to the light-emitting element 132 in accordance with the voltage of the constant voltage circuit. The constant current circuit may be formed by a transistor or the like. Note that the rectifying and smoothing circuit is provided on the assumption that a commercial alternating-current power source is used as the external power source; however, the rectifying and smoothing circuit is not necessarily provided in the case of using a direct-current power source as the external power source. The control circuit 152 may be provided with a circuit for controlling luminance, a protective circuit for protection against surge, or the like as needed.

FIG. 1 illustrates an example in which a bump connection with the conductive layers 120*a* and 120*b* is used for connecting portions of the connection member 150 and the light-emitting element 132; however, any of other methods or structures can be employed as long as electrical connection in the connecting portions of the connection member 150 and the light-emitting element 132 is obtained. For example, any of the followings may be used for the connecting portions of the connection member 150 and the light-emitting element 132; an anisotropic conductive film is used; or a conductive film to be used is formed using a material which can be connected by a solder and connection is performed with the use of a solder. The conductive layer 120*a* and the conductive layer 120*b* can be connected and fixed to the first connection wiring 156 and the second connection wiring 154, respectively, with the use of an anisotropic conductive film or a solder. In addition, a resin for fixing may be provided on the periphery of the connection portion.

The connection member 150 can have a variety of shapes as long as the connection wiring enabling electrical connection with the light-emitting element 132 and the extraction wiring through which power is supplied from the external power source are included.

The method for manufacturing the lighting device is described using FIGS. 4A to 4D and FIGS. 5A and 5B.

Figure 4A:
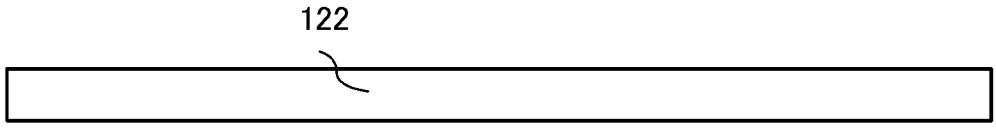
FIGS. 4A to 4D are cross-sectional views illustrating a lighting device.
Figure 4B:
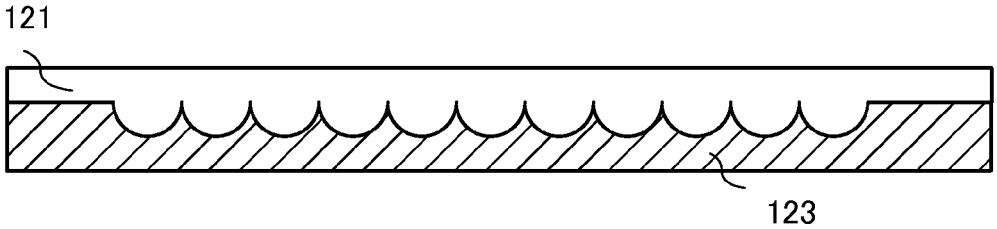

An organic resin 122 which is to be a housing is prepared as illustrated in FIG. 4A. Next, as illustrated in FIG. 4B, the organic resin 122 is processed using a support 123 serving as a mold of the shape to form a first housing 121 having projections and depressions. The shape of the organic resin 122 can be processed by heat treatment or light irradiation treatment depending on the characteristics of the organic resin 122. For example, a thermoplastic organic resin is used as the organic resin 122; the organic resin 122 is pressed into the support 123 while heat treatment is performed, so that the organic resin 122 is changed in shape so as to reflect the shape of the support 123; and then, cooling is performed to perform hardening.

The light-emitting element 132 including the first electrode 104, an auxiliary wiring 124, an insulating layer 135, the EL layer 106, the second electrode 108, and a terminal 136 is formed over the first housing 121.

Figure 4C:
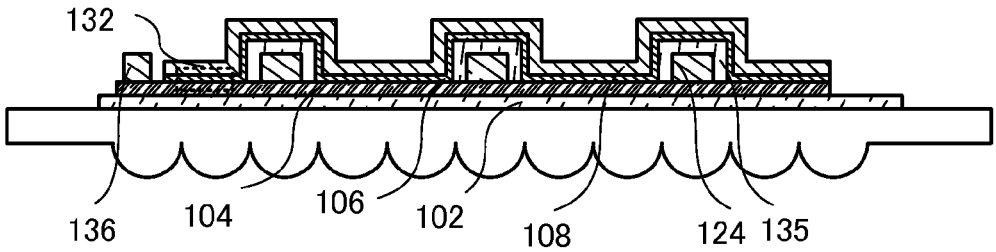

As illustrated in FIG. 4C, the electrode of the light-emitting element and an external electrode may be electrically connected to each other using the auxiliary wiring. There are a variety of structures to be employed for the lighting device which is provided with the connecting portion for connection to the external power source; therefore, the structure is not limited to that described in this embodiment. The lighting device illustrated in FIGS. 4A to 4D and FIGS. 5A and 5B is an example in which the auxiliary wiring 124 which is electrically connected to the first electrode 104 is provided. The auxiliary wiring 124 is covered with the insulating layer 135. The electrode of the light-emitting element is electrically connected to the first connection wiring 156 of the external power source through the conductive layer 120*a* by the terminal 136 which is electrically connected to the auxiliary wiring 124.

For the auxiliary wiring 124, a conductive material may be used. For example, the auxiliary wiring 124 can be formed with a single layer or a stacked layer using material selected from aluminum (Al), titanium (Ti), tantalum (Ta), tungsten (W), molybdenum (Mo), chromium (Cr), neodymium (Nd), scandium (Sc), nickel (Ni) and copper (Cu), or an alloy material containing any of these as its main component. Alternatively, the auxiliary wiring 124 may be formed using a conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added.

Figure 4D:
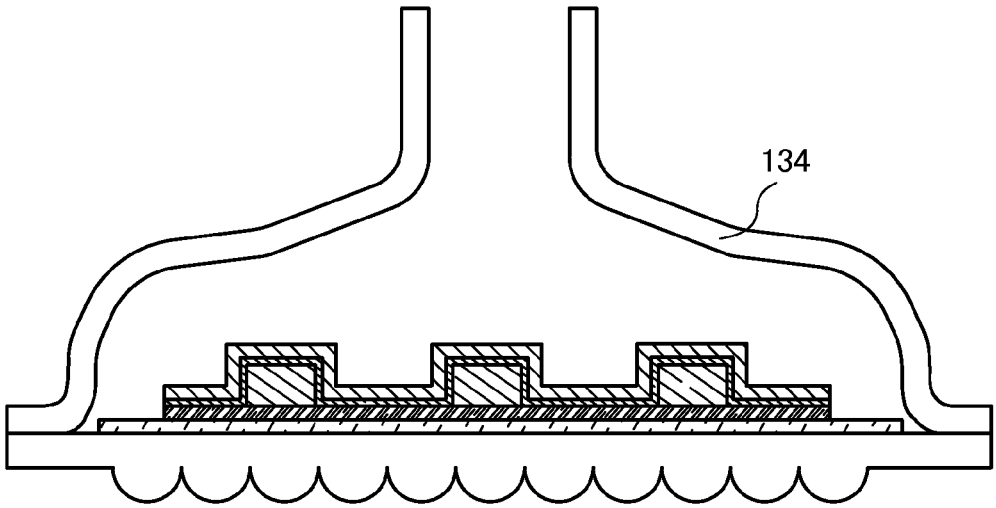

As illustrated in FIG. 4D, the first housing 121 and the second housing 134 are attached to each other to cover the light-emitting element 132.

Next, an electrode 126 connected to a power source 129 is inserted from the opening of the second housing 134 into the inside. Then, a valve 127 is opened, a source gas for deposition is supplied from a gas supply source 128 to the inside of the housing, and the inorganic insulating film 110 which covers the inner wall of the second housing 134 and the top surface of the light-emitting element 132 is formed (see FIG. 5A). At this time, a mask 137 is provided in the vicinity of the opening of the second housing 134 where the connection member 150 is provided so that the inorganic insulating film 110 is not formed in the vicinity of the opening. In this manner, the inorganic insulating film 110 can be formed to successively cover the second housing 134 and the top surface of the light-emitting element 132 and is effective as a protective film that blocks contaminants for the light-emitting element 132.

Figure 5A:
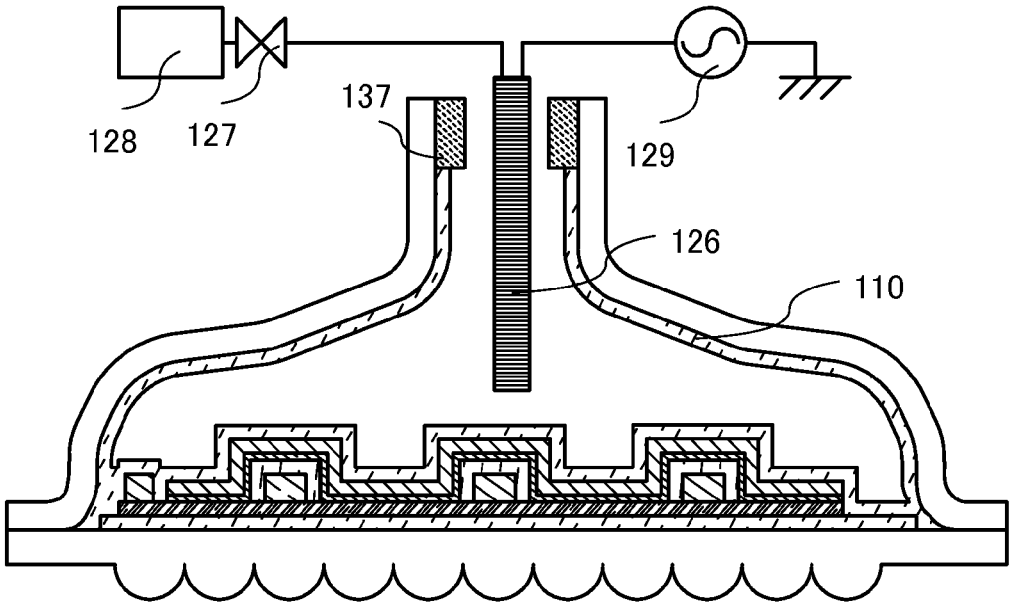
FIGS. 5A and 5B are cross-sectional views illustrating a lighting device.
Figure 5B:
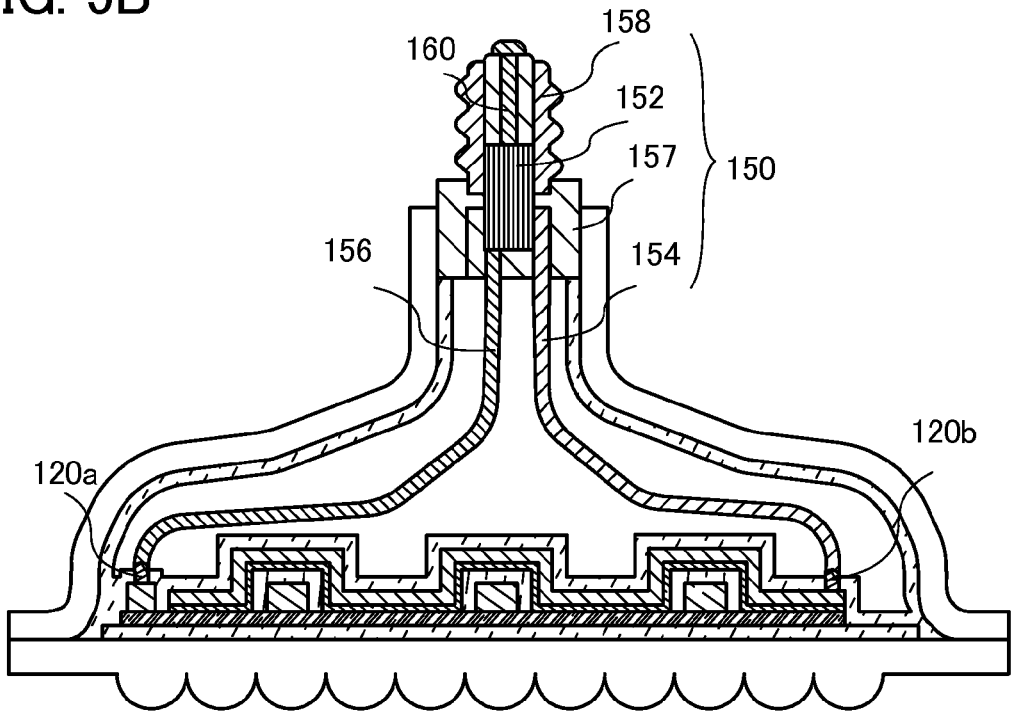

As illustrated in FIG. 5B, the connection member 150 is provided in the opening of the second housing 134, the first electrode 104 of the light-emitting element 132 and the first connection wiring 156 are electrically connected to each other via the conductive layer 120*a*, and the second electrode 108 and the second connection wiring 154 are electrically connected to each other via the conductive layer 120*b*. Through the above steps, the lighting device can be manufactured.

A water absorptive substance serving as a drying agent may be provided in a space between the first housing 100 and the second housing 134 which are provided to cover the light-emitting element 132. The water absorptive substance in a solid state such as in a powder state may be provided, or a film containing the water absorptive substance may be provided over the inorganic insulating film 110 and the light-emitting element 132 by a deposition method such as a sputtering method.

Since an organic resin is used for the housing covering the EL layer in the lighting device of this embodiment, reduction in the weight of the lighting device can be achieved. In addition, since an organic resin whose refractive index is equal to or greater than that of the EL layer is used for the housing, reflection of the light emitted from the EL layer at the interface between the light-emitting element and the housing can be reduced. Further, since a structure in which degradation of an element is not easily caused is employed, a long-lifetime lighting device can be provided. Accordingly, high reliability can be achieved in the lighting device that is one embodiment of the present invention.

This embodiment can be implemented in appropriate combination with any of the structures described in the other embodiments.

Embodiment 2

In this embodiment, an example of a lighting device including an auxiliary wiring having a structure which is different from that of Embodiment 1 is described with reference to FIG. 10. Accordingly, except the structure of the auxiliary wiring, the lighting device can be manufactured in a manner similar to that in Embodiment 1; thus, repetitive description of the same components as or components having functions similar to those in Embodiment 1 and manufacturing steps is omitted.

Figure 10:
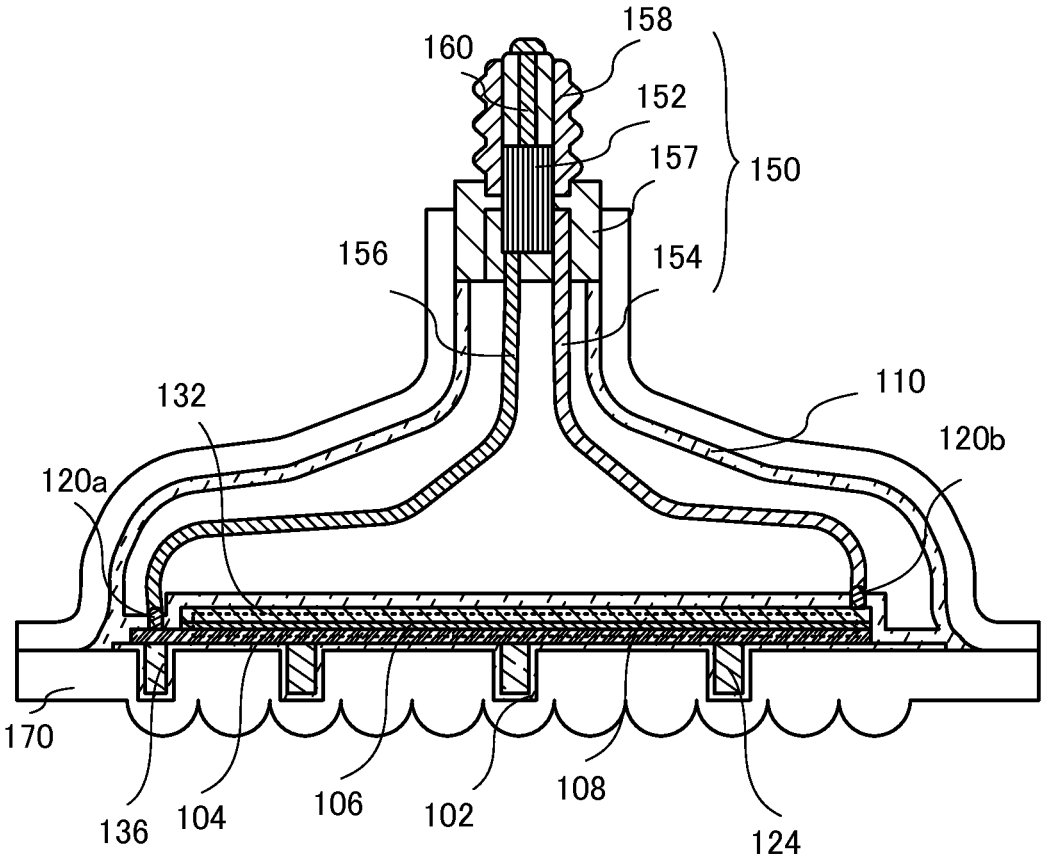
FIG. 10 is a cross-sectional view illustrating a lighting device.

As illustrated in FIG. 10, auxiliary wirings 124 are provided in depression portions (groove portions) which are provided in a first housing 170 in this embodiment.

The depression portions of the first housing 170 can be formed at the same time when an organic resin is processed with the use of a support serving as a mold so as to have a shape having projections and depressions. Needless to say, the depression portions may be formed in the first housing 170 by etching in a different step.

An inorganic insulating film 102 is formed over the first housing 170 having the depression portions, and the auxiliary wirings 124 and a terminal 136 are formed over the inorganic insulating film 102 to be embedded in the depression portions of the first housing 170.

As the auxiliary wirings 124, such a conductive material described in Embodiment 1 can be used. The auxiliary wirings 124 and the terminal 136 can be formed in such a manner that a conductive film is formed by a sputtering method, a vapor deposition method, a coating method, or the like and the conductive film is selectively removed.

Alternatively, the auxiliary wirings 124 and the terminal 136 may be selectively formed using an ink-jet method, a printing method, or the like. For example, the auxiliary wirings 124 and the terminal 136 can be provided using a printing method in such a manner that a conductive paste including an organic resin into which conductive particles each having a diameter of several nanometers to several tens of micrometers are dissolved or dispersed is selectively printed. As the conductive particle, at least one of metal particles of silver (Ag), gold (Au), copper (Cu), nickel (Ni), platinum (Pt), palladium (Pd), tantalum (Ta), molybdenum (Mo), titanium (Ti), and the like or fine particles of silver halide can be used. In addition, as the organic resin included in the conductive paste, one or more selected from organic resins functioning as a binder of metal particles, a solvent, a dispersing agent and a coating material can be used. Organic resins such as an epoxy resin or a silicone resin can be given as representative examples. Further, in forming the conductive layer, it is preferable to bake the conductive paste after being extruded. Alternatively, fine particles containing a solder or a lead-free solder as its main component may be used. Note that the conductive paste can also be used for the conductive layers 120*a* and 120*b* which electrically connect the light-emitting element 132 and the connection member 150.

A first electrode 104 is formed to be in contact with the auxiliary wirings 124 and the terminal 136, and the EL layer 106 and the second electrode 108 are stacked over the first electrode 104 to form the light-emitting element 132. Note that an example in which the terminal 136 is electrically connected to the conductive layer 120*a* via the first electrode 104 is described in this embodiment; however, the first electrode 104 over the terminal 136 may be selectively removed to expose the terminal 136, and the terminal 136 may be directly and electrically connected to the conductive layer 120*a*.

By forming the auxiliary wirings 124 in the depression portions provided in the first housing 170, the thickness of the auxiliary wirings 124 can be increased; therefore, the width of the auxiliary wirings 124 can be further reduced while keeping the resistance of the auxiliary wirings 124 low. In addition, by providing the light-reflective auxiliary wirings 124, a light emitted from the light-emitting element 132 can be scattered, so that an effect of improving light extraction efficiency can be obtained. Accordingly, the lighting device of this embodiment can be a lighting device with low power consumption and high light extraction efficiency.

Since an organic resin is used for the housing covering the EL layer, reduction in the weight of the lighting device of this embodiment can be achieved. In addition, since an organic resin whose refractive index is equal to or greater than that of the EL layer is used for the housing, reflection of light emitted from the EL layer at the interface between the light-emitting element and the housing can be reduced. Further, since a structure in which degradation of an element is not easily caused is employed, a long-lifetime lighting device having can be provided. Accordingly, high reliability can be achieved in the lighting device that is one embodiment of the present invention.

This embodiment can be implemented in appropriate combination with any of the structures described in the other embodiments.

Embodiment 3

In this embodiment, examples of a structure of a light-emitting element used for a lighting device that is one embodiment of the present invention will be described.

Figure 7A:
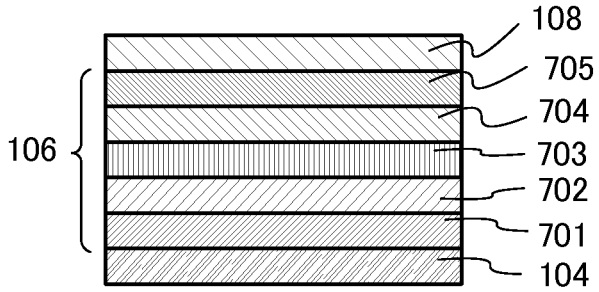
FIGS. 7A to 7C each illustrate an example of a light-emitting element which is applicable to a lighting device.

A light-emitting element illustrated in FIG. 7A includes a first electrode 104, an EL layer 106 over the first electrode 104, and a second electrode 108 over the EL layer 106.

The EL layer 106 includes at least a light-emitting layer containing a light-emitting organic compound. In addition, the EL layer 106 can be formed with a stacked-layer structure in which a layer containing a substance having a high electron-transport property, a layer containing a substance having a high hole-transport property, a layer containing a substance having a high electron-injection property, a layer containing a substance having a high hole-injection property, a layer containing a bipolar substance (a substance having a high electron-transport property and a high hole-transport property), and the like are combined as appropriate. In this embodiment, a hole-injection layer 701, a hole-transport layer 702, a light-emitting layer 703, an electron-transport layer 704, and an electron-injection layer 705 are stacked in this order from the first electrode 104 side in the EL layer 106. Further, in this embodiment, the refractive index of the EL layer 106 is greater than or equal to 1.7.

A method for manufacturing the light-emitting element illustrated in FIG. 7A is described.

First, the first electrode 104 is formed. The first electrode 104 is provided in the direction in which light is extracted from the EL layer, and thus is formed using a light-transmitting material.

As the light-transmitting material, indium oxide, an alloy of indium tin oxide (also referred to as ITO), indium zinc oxide (also referred to as IZO), zinc oxide, zinc oxide to which gallium is added, graphane, or the like can be used.

In addition, as the first electrode 104, a metal material such as gold, platinum, nickel, tungsten, chromium, molybdenum, iron, cobalt, copper, palladium, or titanium can be used. Further, a nitride of any of the metal materials (such as titanium nitride) or the like may be used. In the case of using the metal material (or the nitride thereof), the first electrode 104 may be thinned so as to be able to transmit light.

Next, the EL layer 106 is formed over the first electrode 104. In this embodiment, the EL layer 106 includes the hole-injection layer 701, the hole-transport layer 702, the light-emitting layer 703, the electron-transport layer 704, and the electron-injection layer 705.

The hole-injection layer 701 is a layer that contains a substance having a high hole-injection property. As the substance having a high hole-injection property, for example, metal oxide such as molybdenum oxide, titanium oxide, vanadium oxide, rhenium oxide, ruthenium oxide, chromium oxide, zirconium oxide, hafnium oxide, tantalum oxide, silver oxide, tungsten oxide, or manganese oxide can be used. A phthalocyanine-based compound such as phthalocyanine (abbreviation: $H_2Pc$), or copper(II)phthalocyanine (abbreviation: CuPc) can also be used.

Alternatively, any of the following aromatic amine compounds which are low molecular organic compounds can be used: 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), 4,4'-bis[N-(4-diphenylaminophenyl)-N-phenylamino]biphenyl (abbreviation: DPAB), 4,4'-bis(N-{4-[N'-(3-methylphenyl)-N'-phenylamino]phenyl}-N-phenylamino)biphenyl (abbreviation: DNTPD), 1,3,5-tris[N-(4-diphenylaminophenyl)-N-phenylamino]benzene (abbreviation: DPA3B), 3-[N-(9-phenylcarbazol-3-yl)-N-phenylamino]-9-phenylcarbazole (abbreviation: PCzPCA1), 3,6-bis[N-(9-phenylcarbazol-3-yl)-N-phenylamino]-9-phenylcarbazole (abbreviation: PCzPCA2), 3-[N-(1-naphthyl)-N-(9-phenylcarbazol-3-yl)amino]-9-phenylcarbazole (abbreviation: PCzPCN1), or the like.

Further alternatively, any of high molecular compounds (e.g., oligomers, dendrimers, or polymers) can be used. Examples of high molecular compounds include poly(N-vinylcarbazole) (abbreviation: PVK), poly(4-vinyltriphenylamine) (abbreviation: PVTPA), poly[N-(4-{N'-[4-(4-diphenylamino)phenyl]phenyl-N'-phenylamino}phenyl) methacrylamide] (abbreviation: PTPDMA), and poly[N,N'-bis(4-butylphenyl)-N,N-bis(phenyl)benzidine (abbreviation: Poly-TPD). Alternatively, a high molecular compound to which acid is added, such as poly(3,4-ethylenedioxythiophene)/poly(styrenesulfonic acid) (PEDOT/PSS) or polyaniline/poly(styrenesulfonic acid) (PAni/PSS), can be used.

In particular, for the hole-injection layer 701, a composite material in which an acceptor substance is mixed with an organic compound having a high hole-transport property is preferably used. By the use of the composite material in which an acceptor substance is added to a substance having a high hole-transport property, hole injection from the first electrode 104 is facilitated, which leads to a reduction in the driving voltage of the light-emitting element. Such a composite material can be formed by co-depositing a substance having a high hole-transport property and an acceptor substance. The hole-injection layer 701 is formed using the composite material, whereby hole injection from the first electrode 104 to the EL layer 106 is facilitated.

As the organic compound for the composite material, any of various compounds such as aromatic amine compounds, carbazole derivatives, aromatic hydrocarbon, and high molecular compounds (e.g., oligomer, dendrimer, or polymer) can be used. The organic compound used for the composite material is preferably an organic compound having a high hole-transport property. Specifically, a substance having a hole mobility of $10^{-6}$ $cm^2/Vs$ or higher is preferably used. However, a substance other than these substances may also be used as long as a hole-transport property thereof is higher than an electron-transport property thereof. The organic compounds which can be used for the composite material are specifically described below.

Examples of the organic compounds that can be used for the composite material include: aromatic amine compounds such as TDATA, MTDATA, DPAB, DNTPD, DPA3B, PCzPCA1, PCzPCA2, PCzPCN1, 4,4'-bis[N-(1-naphthyl)-N-phenylamino]biphenyl (abbreviation: NPB or α-NPD), and N,N'-bis(3-methylphenyl)-N,N'-diphenyl-[1,1'-biphenyl]-4,4'-diamine (abbreviation: TPD), and 4-phenyl-4'-(9-phenylfluoren-9-yl)triphenylamine (abbreviation: BPAFLP); and carbazole derivatives such as 4,4'-di(N-carbazolyl)biphenyl (abbreviation: CBP), 1,3,5-tris[4-(N-carbazolyl)phenyl]benzene (abbreviation: TCPB), 9-[4-(10-phenyl-9-anthryl)phenyl]-9H-carbazole (abbreviation: CzPA), 9-phenyl-3-[4-(10-phenyl-9-anthryl)phenyl]-9H-carbazole (abbreviation: PCzPA), and 1,4-bis[4-(N-carbazolyl)phenyl-2,3,5,6-tetraphenylbenzene.

In addition, it is possible to use any of the following aromatic hydrocarbon compounds: 2-tert-butyl-9,10-di(2-naphthyl)anthracene (abbreviation: t-BuDNA), 2-tert-butyl-9,10-di(1-naphthyl)anthracene, 9,10-bis(3,5-diphenylphenyl)anthracene (abbreviation: DPPA), 2-tert-butyl-9,10-bis(4-phenylphenyl)anthracene (abbreviation: t-BuDBA), 9,10-di(2-naphthyl)anthracene (abbreviation: DNA), 9,10-diphenylanthracene (abbreviation: DPAnth), 2-tert-butylanthracene (abbreviation: t-BuAnth), 9,10-bis(4-methyl-1-naphthyl)anthracene (abbreviation: DMNA), 9,10-bis[2-(1-naphthyl)phenyl]-2-tert-butylanthracene, 9,10-bis[2-(1-naphthyl)phenyl]anthracene, 2,3,6,7-tetramethyl-9,10-di(1-naphthyl)anthracene, or the like.

Further alternatively, an aromatic hydrocarbon compound such as 2,3,6,7-tetramethyl-9,10-di(2-naphthyl)anthracene, 9,9'-bianthryl, 10,10'-diphenyl-9,9'-bianthryl, 10,10'-bis(2-phenylphenyl)-9,9'-bianthryl, 10,10'-bis[(2,3,4,5,6-pentaphenyl)phenyl]-9,9'-bianthryl, anthracene, tetracene, rubrene, perylene, 2,5,8,11-tetra(tert-butyl)perylene, pentacene, coronene, 4,4'-bis(2,2-diphenylvinyl)biphenyl (abbreviation: DPVBi), or 9,10-bis[4-(2,2-diphenylvinyl)phenyl]anthracene (abbreviation: DPVPA) can be used.

Further, as the electron acceptor, organic compounds such as 7,7,8,8-tetracyano-2,3,5,6-tetrafluoroquinodimethane (abbreviation: $F_4$-TCNQ) and chloranil; and transition metal oxides can be given. In addition, oxides of metals belonging to Groups 4 to 8 in the periodic table can also be given. Specifically, vanadium oxide, niobium oxide, tantalum oxide, chromium oxide, molybdenum oxide, tungsten oxide, manganese oxide, and rhenium oxide are preferable since their electron-accepting property is high. Among these, molybdenum oxide is especially preferable since it is stable in the atmosphere and its hygroscopic property is low and is easily treated.

The composite material may be formed using the above-described electron acceptor and the above-described high molecular compound such as PVK, PVTPA, PTPDMA, or Poly-TPD and used for the hole-injection layer 701.

The hole-transport layer 702 is a layer that contains a substance having a high hole-transport property. As the substance having a high hole-transport property, any of the following aromatic amine compounds can be used, for example: NPB; TPD; BPAFLP; 4,4'-bis[N-(9,9-dimethylfluoren-2-yl)-N-phenylamino]biphenyl (abbreviation: DFLDPBi); and 4,4'-bis[N-(spiro-9,9'-bifluoren-2-yl)-N-phenylamino]biphenyl (abbreviation: BSPB). The substances mentioned here mainly have a hole mobility of $10^{-6}$ $cm^2/Vs$ or higher. However, a substance other than these substances may also be used as long as a hole-transport property thereof is higher than an electron-transport property thereof. The layer that contains a substance having a high hole-transport property is not limited to a single layer, and two or more layers that contain the above-described substances may be stacked.

For the hole-transport layer 702, a carbazole derivative such as CBP, CzPA, or PCzPA or an anthracene derivative such as t-BuDNA, DNA, or DPAnth may be used.

For the hole-transport layer 702, a high molecular compound such as PVK, PVTPA, PTPDMA, or Poly-TPD can be used.

The light-emitting layer 703 is a layer that contains an organic compound having a light-emitting property. As the organic compound having a light-emitting property, for example, a fluorescent compound which exhibits fluorescence or a phosphorescent compound which exhibits phosphorescence can be used.

The fluorescent compounds that can be used for the light-emitting layer 703 are given below. Examples of the materials that emit blue light include N,N'-bis[4-(9H-carbazol-9-yl)phenyl]-N,N'-diphenylstilbene-4,4'-diamine (abbreviation: YGA2S), 4-(9H-carbazol-9-yl)-4'-(10-phenyl-9-anthryl)triphenylamine (abbreviation: YGAPA), 4-(10-phenyl-9-anthryl)-4'-(9-phenyl-9H-carbazol-3-yl)triphenylamine (abbreviation: PCBAPA), and the like. In addition, examples of the materials that emit green light include N-(9,10-diphenyl-2-anthryl)-N,9-diphenyl-9H-carbazol-3-amine (abbreviation: 2PCAPA), N-[9,10-bis(1,1'-biphenyl-2-yl)-2-anthryl]-N,9-diphenyl-9H-carbazol-3-amine (abbreviation: 2PCABPhA), N-(9,10-diphenyl-2-anthryl)-N,N',N'-triphenyl-1,4-phenylenediamine (abbreviation: 2DPAPA), N-[9,10-bis(1,1'-biphenyl-2-yl)-2-anthryl]-N,N',N'-triphenyl-1,4-phenylenediamine (abbreviation: 2DPABPhA), N-[9,10-bis(1,1'-biphenyl-2-yl)]-N-[4-(9H-carbazol-9-yl)phenyl]-N-phenylanthracen-2-amine (abbreviation: 2YGABPhA), N,N,9-triphenylanthracen-9-amine (abbreviation: DPhAPhA), and the like. Further, examples of the materials that emit yellow light include rubrene, 5,12-bis(1,1'-biphenyl-4-yl)-6,11-diphenyltetracene (abbreviation: BPT), and the like. Furthermore, examples of the materials that emit red light include N,N,N',N'-tetrakis(4-methylphenyl)tetracene-5,11-diamine (abbreviation: p-mPhTD), 7,14-diphenyl-N,N,N',N'-tetrakis(4-methylphenyl)acenaphtho[1,2-a]fluoranthene-3,10-diamine (abbreviation: p-mPhAFD), and the like.

The phosphorescent compounds that can be used for the light-emitting layer 703 are given below. Examples of the materials that emit blue light include bis[2-(4',6'-difluorophenyl)pyridinato-N,$C^{2'}$]iridium(III)tetrakis(1-pyrazolyl)borate (abbreviation: FIr6), bis[2-(4',6'-difluorophenyl)pyridinato-N,$C^{2'}$]iridium(III)picolinate (abbreviation: FIrpic), bis{2-[3',5'-bis(trifluoromethyl)phenyl]pyridinato-N,$C^{2'}$}iridium(III)picolinate (abbreviation: $Ir(CF_3ppy)_2(pic)$), bis[2-(4',6'-difluorophenyl)pyridinato-N,$C^{2'}$]iridium(III)acetylacetonate (abbreviation: FIr(acac)), and the like. Examples of the materials that emit green light include tris(2-phenylpyridinato-N,$C^{2'}$)iridium(III) (abbreviation: $Ir(ppy)_3$), bis(2-phenylpyridinato-N,$C^{2'}$)iridium(III)acetylacetonate (abbreviation: $Ir(ppy)_2(acac)$), bis(1,2-diphenyl-1H-benzimidazolato)iridium(III)acetylacetonate (abbreviation: $Ir(pbi)_2(acac)$), bis(benzo[h]quinolinato)iridium(III)acetylacetonate (abbreviation: $Ir(bzq)_2(acac)$), tris(benzo[h]quinolinato)iridium(III) (abbreviation: $Ir(bzq)_3$), and the like. Examples of the materials that emit yellow light include bis(2,4-diphenyl-1,3-oxazolato-N,$C^{2'}$)iridium(III)acetylacetonate (abbreviation: $Ir(dpo)_2(acac)$), bis[2-(4'-(perfluorophenylphenyl)pyridinato]iridium(III)acetylacetonate (abbreviation: $Ir(p\text{-}PF\text{-}ph)_2(acac)$), bis(2-phenylbenzothiazolato-N,$C^{2'}$)iridium(III)acetylacetonate (abbreviation: $Ir(bt)_2(acac)$), (acetylacetonato)bis[2,3-bis(4-fluorophenyl)-5-methylpyrazinato]iridium(III) (abbreviation: $Ir(Fdppr\text{-}Me)_2(acac)$), (acetylacetonato)bis{2-(4-methoxyphenyl)-3,5-dimethylpyrazinato}iridium(III) (abbreviation: $Ir(dmmoppr)_2(acac)$), and the like.

Examples of the materials that emit orange light include tris(2-phenylquinolinato-N,$C^{2'}$)iridium(III) (abbreviation: $Ir(pq)_3$), bis(2-phenylquinolinato-N,$C^{2'}$)iridium(III)acetylacetonate (abbreviation: $Ir(pq)_2(acac)$), (acetylacetonato)bis(3,5-dimethyl-2-phenylpyrazinato)iridium(III) (abbreviation: $Ir(mppr\text{-}Me)_2(acac)$), (acetylacetonato)bis(5-isopropyl-3-methyl-2-phenylpyrazinato)iridium(III) (abbreviation: $Ir(mppr\text{-}iPr)_2(acac)$), and the like. Examples of the materials that emit red light include organometallic complexes such as bis[2-(2'-benzo[4,5-α]thienyl)pyridinato-N,$C^{3'}$)iridium(III) acetylacetonate (abbreviation: $Ir(btp)_2(acac)$), bis(1-phenylisoquinolinato-N,$C^{2'}$)iridium(III)acetylacetonate (abbreviation: $Ir(piq)_2(acac)$), (acetylacetonato)bis[2,3-bis(4-fluorophenyl)quinoxalinato]iridium(III) (abbreviation: $Ir(Fdpq)_2(acac)$), (acetylacetonato)bis(2,3,5-triphenylpyrazinato)iridium(III) (abbreviation: $Ir(tppr)_2(acac)$), (dipivaloylmethanato)bis(2,3,5-triphenylpyrazinato)iridium(III) (abbreviation: $Ir(tppr)_2(dpm)$), and (2,3,7,8,12,13,17,18-octaethyl-21H,23H-porphine)platinum(II) (abbreviation: PtOEP). Any of the following rare earth metal complexes can be used as a phosphorescent compound: tris(acetylacetonato)(monophenanthroline)terbium(III) (abbreviation: $Tb(acac)_3(Phen)$); tris(1,3-diphenyl-1,3-propanedionato)(monophenanthroline)europium(III) (abbreviation: $Eu(DBM)_3(Phen)$); and tris[1-(2-thenoyl)-3,3,3-trifluoroacetonato](monophenanthroline)europium(III) (abbreviation: $Eu(TTA)_3(Phen)$), because their light emission (generated by electronic transition between different multiplicities) is from a rare earth metal ion.

Note that the light-emitting layer 703 may have a structure in which the above-described light-emitting organic compound (a guest material) is dispersed in another substance (a host material). As a host material, various kinds of materials can be used, and it is preferable to use a substance which has a lowest unoccupied molecular orbital level (LUMO level) higher than the light-emitting substance and has a highest occupied molecular orbital level (HOMO level) lower than that of the light-emitting substance.

Specific examples of the host material are as follows: a metal complex such as tris(8-quinolinolato)aluminum(III) (abbreviation: Alq), tris(4-methyl-8-quinolinolato)aluminum(III) (abbreviation: $Almq_3$), bis(10-hydroxybenzo[h]quinolinato)beryllium(II) (abbreviation: $BeBq_2$), bis(2-methyl-8-quinolinolato)(4-phenylphenolato)aluminum(III) (abbreviation: BAlq), bis(8-quinolinolato)zinc(II) (abbreviation: Znq), bis[2-(2-benzoxazolyl)phenolato]zinc(II) (abbreviation: ZnPBO), or bis[2-(2-benzothiazolyl)phenolato]zinc(II) (abbreviation: ZnBTZ); a heterocyclic compound such as 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 3-(4-biphenylyl)-4-phenyl-5-(4-tert-butylphenyl)-1,2,4-triazole (abbreviation: TAZ), 2,2',2"-(1,3,5-benzenetriyl)tris(1-phenyl-1H-benzimidazole) (abbreviation: TPBI), bathophenanthroline (abbreviation: BPhen), or bathocuproine (BCP); a condensed aromatic compound such as 9-[4-(10-phenyl-9-anthryl)phenyl]-9H-carbazole (abbreviation: CzPA), 3,6-diphenyl-9-[4-(10-phenyl-9-anthryl)phenyl]-9H-carbazole (abbreviation: DPCzPA), 9,10-bis(3,5-diphenylphenyl)anthracene (abbreviation: DPPA), 9,10-di(2-naphthyl)anthracene (abbreviation: DNA), 2-tert-butyl-9,10-di(2-naphthyl)anthracene (abbreviation: t-BuDNA), 9,9'-bianthryl (abbreviation: BANT), 9,9'-(stilbene-3,3'-diyl)diphenanthrene (abbreviation: DPNS), 9,9'-(stilbene-4,4'-diyl)diphenanthrene (abbreviation: DPNS2), 3,3',3"-(benzene-1,3,5-triyl)tripyrene (abbreviation: TPB3), 9,10-diphenylanthracene (abbreviation: DPAnth), or 6,12-dimethoxy-5,11-diphenylchrysene; an aromatic amine compound such as N,N-dipheyl-9-[4-(10-phenyl-9-anthryl)phenyl]-9H-carbazol-3-amine (abbreviation: CzA1PA), 4-(10-phenyl-9-anthryl)triphenylamine (abbreviation: DPhPA), N,9-diphenyl-N-[4-(10-phenyl-9-anthryl)phenyl]-9H-carbazol-3-amine (abbreviation: PCAPA), N,9-diphenyl-N-{4-[4-(10-phenyl-9-anthryl)phenyl]phenyl}-9H-carbazol-3-amine (abbreviation: PCAPBA), N-(9,10-diphenyl-2-anthryl)-N,9-diphenyl-9H-carbazol-3-amine (abbreviation: 2PCAPA), NPB (or α-NPD), TPD, DFLDPBi, or BSPB; and the like.

Alternatively, as the host material, plural kinds of materials can be used. For example, in order to suppress crystallization, a substance such as rubrene which suppresses crystallization, may be further added. In addition, NPB, Alq, or the like may be further added in order to efficiently transfer energy to the guest material.

When a structure in which a guest material is dispersed in a host material is employed, crystallization of the light-emitting layer 703 can be suppressed. Further, concentration quenching due to high concentration of the guest material can be suppressed.

For the light-emitting layer 703, a high molecular compound can be used. Specifically, examples of the materials that emit blue light include poly(9,9-dioctylfluorene-2,7-diyl) (abbreviation: PFO), poly[(9,9-dioctylfluorene-2,7-diyl)-co-(2,5-dimethoxybenzene-1,4-diyl)] (abbreviation: PF-DMOP), poly{(9,9-dioctylfluorene-2,7-diyl)-co-[N,N'-di-(p-butylphenyl)-1,4-diaminobenzene]} (abbreviation: TAB-PFH), and the like. Further, examples of the materials that emit green light include poly(p-phenylenevinylene) (abbreviation: PPV), poly[(9,9-dihexylfluorene-2,7-diyl)-alt-co-(benzo[2,1,3]thiadiazole-4,7-diyl)] (abbreviation: PFBT), poly[(9,9-dioctyl-2,7-divinylenefluorenylene)-alt-co-(2-methoxy-5-(2-ethylhexyloxy)-1,4-phenylene)], and the like. Furthermore, examples of the materials that emit orange to red light include poly[2-methoxy-5-(2'-ethylhexoxy)-1,4-phenylenevinylene] (abbreviation: MEH-PPV), poly(3-butylthiophene-2,5-diyl) (abbreviation: R4-PAT), poly{[9,9-dihexyl-2,7-bis(1-cyanovinylene)fluorenylene]-alt-co-[2,5-bis(N,N'-diphenylamino)-1,4-phenylene]}, poly{[2-methoxy-5-(2-ethylhexyloxy)-1,4-bis(1-cyanovinylenephenylene)]-alt-co-[2,5-bis(N,N'-diphenylamino)-1,4-phenylene]} (abbreviation: CN-PPV-DPD), and the like.

Note that the light-emitting layer may have a stacked-layer structure of two or more layers. When the light-emitting layer has a stacked-layer structure of two or more layers and the kind of light-emitting substance used for each light-emitting layer is changed, various emission colors can be obtained. In addition, by using plural kinds of light-emitting substances having different emission colors, light emission with a broad spectrum or white light emission can also be obtained. A light-emitting layer having a stacked-layer structure is preferably used particularly for lighting devices that require high luminance The electron-transport layer 704 is a layer containing a substance having a high electron-transport property. As the substance having a high electron-transport property, any of the following substances can be used, for example: a metal complex having a quinoline skeleton or a benzoquinoline skeleton such as tris(8-quinolinolato)aluminum (abbreviation: Alq), tris(4-methyl-8-quinolinolato)aluminum (abbreviation: $Almq_3$), bis(10-hydroxybenzo[h]quinolinato)beryllium (abbreviation: $BeBq_2$), or bis(2-methyl-8-quinolinolato)(4-phenylphenolato)aluminum (abbreviation: BAlq). Alternatively, a metal complex or the like including an oxazole-based or thiazole-based ligand, such as bis[2-(2-hydroxyphenyl)benzoxazolato]zinc (abbreviation: $Zn(BOX)_2$) or bis[2-(2-hydroxyphenyl)benzothiazolato]zinc (abbreviation: $Zn(BTZ)_2$) can be used. Besides the metal complexes, 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 3-(4-biphenylyl)-4-phenyl-5-(4-tert-butylphenyl)-1,2,4-triazole (abbreviation: TAZ), bathophenanthroline (abbreviation: BPhen), bathocuproine (abbreviation: BCP), or the like can also be used. The substances mentioned here mainly have an electron mobility of $10^{-6}$ $cm^2/Vs$ or higher. Furthermore, the electron-transport layer is not limited to a single layer, and two or more layers that contain the above-described substances may be stacked.

The electron-injection layer 705 is a layer that contains a substance having a high electron-injection property. For the electron-injection layer 705, an alkali metal, an alkaline-earth metal, or a compound thereof, such as lithium, cesium, calcium, lithium fluoride, cesium fluoride, calcium fluoride, or lithium oxide, can be used. In addition, a rare earth metal compound such as erbium fluoride can also be used. Any of the substances contained in the electron-transport layer 704 which are given above can also be used.

Note that the hole-injection layer 701, the hole-transport layer 702, the light-emitting layer 703, the electron-transport layer 704, and the electron-injection layer 705 which are described above can each be formed by a method such as an deposition method (e.g., a vacuum evaporation method), an ink-jet method, or a coating method.

Figure 7B:
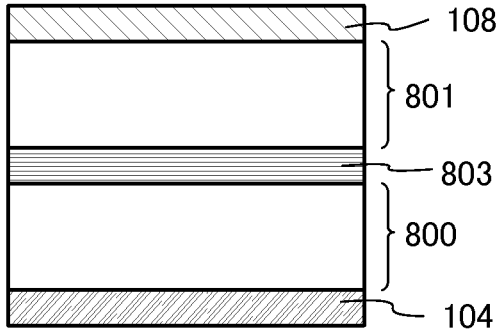

Note that a plurality of EL layers may be stacked between the first electrode 104 and the second electrode 108 as illustrated in FIG. 7B. In that case, a charge generation layer 803 is preferably provided between a first EL layer 800 and a second EL layer 801 which are stacked. The charge generation layer 803 can be formed using the above-described composite material. Further, the charge generation layer 803 may have a stacked structure including a layer that contains the composite material and a layer that contains another material. In that case, as the layer that contains another material, a layer that contains an electron-donating substance and a substance having a high electron-transport property, a layer formed of a transparent conductive film, or the like can be used. As for a light-emitting element having such a structure, problems such as energy transfer and quenching hardly occur, and a light-emitting element which has both high emission efficiency and a long lifetime can be easily obtained due to expansion in the choice of materials. Moreover, a light-emitting element which provides phosphorescence from one of the EL layers and fluorescence from the other of the EL layers can be readily obtained. Note that this structure can be combined with the above-described structures of the EL layer.

When the charge generation layer 803 is provided between the stacked EL layers as illustrated in FIG. 7B, the element can have high luminance and a long lifetime while the current density is kept low. In addition, the voltage drop due to resistance of the electrode material can be reduced, whereby uniform light emission in a large area is possible.

In the case where an EL layer is a stacked-type element in which two layers are stacked, white light can be extracted to the outside by allowing the first EL layer and the second EL layer to emit light of complementary colors. Note that white light emission can also be obtained in a structure in which each of the first EL layer and the second EL layer includes a plurality of light-emitting layers emitting light of complementary colors. Examples of complementary colors include blue and yellow, and blue-green and red. A substance emitting light of blue, yellow, blue-green, or red may be selected as appropriate from, for example, the light-emitting substances given above.

An example of a light-emitting element having a structure in which a plurality of EL layers are stacked is described below. First, an example of the structure in which each of the first EL layer and the second EL layer includes a plurality of light-emitting layers emitting light of complementary colors is described. With this structure, white light can be obtained.

For example, the first EL layer includes a first light-emitting layer that emits light having an emission spectrum with a peak in the blue to blue-green wavelength range, and a second light-emitting layer that emits light having an emission spectrum with a peak in the yellow to orange wavelength range. The second EL layer includes a third light-emitting layer that emits light having an emission spectrum with a peak in the blue-green to green wavelength range, and a fourth light-emitting layer that emits light having an emission spectrum with a peak in the orange to red wavelength range.

In that case, light emission from the first EL layer is a combination of light emission from both the first light-emitting layer and the second light-emitting layer and thus exhibits an emission spectrum having peaks both in the blue to blue-green wavelength range and in the yellow to orange wavelength range. That is, the first EL layer emits light of two-wavelength white color or almost white color.

Further, light emission from the second EL layer is a combination of light emission from both the third light-emitting layer and the fourth light-emitting layer and thus exhibits an emission spectrum having peaks both in the blue-green to green wavelength range and in the orange to red wavelength range. That is, the second EL layer emits light of two-wavelength white color or almost white color, which is different from that of the first EL layer.

Accordingly, a combination of the light-emission from the first EL layer and the light emission from the second EL layer can provide white light emission that covers the blue to blue-green wavelength range, the blue-green to green wavelength range, the yellow to orange wavelength range, and the orange to red wavelength range.

In addition, since the yellow to orange wavelength range (longer than or equal to 560 nm and shorter than 580 nm) is a wavelength range of high spectral luminous efficacy, it is effective to use an EL layer including a light-emitting layer which has an emission spectrum peak in the yellow to orange wavelength range. For example, a structure in which the a first EL layer including a light-emitting layer which has an emission spectrum peak in the blue wavelength range, a second EL layer including a light-emitting layer which has an emission spectrum peak in the yellow wavelength range, and a third EL layer including a light-emitting layer which has an emission spectrum peak in the red wavelength range are stacked can be used.

Alternatively, two or more EL layers emitting yellow to orange light may be stacked. By stacking two or more EL layers emitting yellow to orange light, the power efficiency of the light-emitting element can be further improved.

For example, in the case of a light-emitting element in which three EL layers are stacked, a structure can be used in which a second EL layer and a third EL layer each including a light-emitting layer having an emission spectrum peak in the yellow to orange wavelength range are stacked over a first EL layer including a light-emitting layer which has an emission spectrum peak in the blue wavelength range (longer than or equal to 400 nm and shorter than 480 nm). Note that the wavelength of the peak of the emission spectrum from the second EL layer may be the same as or different from that from the third EL layer.

The use of the EL layer which has an emission spectrum peak in the yellow to orange wavelength range makes it possible to utilize the wavelength range of high spectral luminous efficacy and to improve power efficiency. Accordingly, the power efficiency of the whole light-emitting element can be increased. Such a structure is advantageous in terms of spectral luminous efficacy and can improve power efficiency in comparison with the case where, for example, an EL layer which emits green light and an EL layer which emits red light are stacked to obtain a light-emitting element which emits yellow to orange light. Further, the emission intensity of light of the blue wavelength range of low spectral luminous efficacy is relatively low in comparison with the case where only one EL layer using a wavelength range of high spectral luminous efficacy located in the yellow to orange wavelength range is used; thus, the color of emitted light is close to light bulb color (or warm white), and the power efficiency is improved.

In other words, when light whose emission spectrum peak is in the yellow to orange wavelength range and whose wavelength of the peak is greater than or equal to 560 nm and less than 580 nm and light whose emission spectrum peak is in the blue wavelength range are combined, the resulting color (i.e., the color of light emitted from the light-emitting element) can be natural color like warm white or light bulb color. In particular, light bulb color can be easily achieved.

For example, an organometallic complex in which a pyrazine derivative serves as a ligand can be used as the light-emitting substance which emits light having a peak in the yellow to orange wavelength range. Alternatively, the light-emitting layer can be formed by dispersing a light-emitting substance (a guest material) in another substance (a host material). A phosphorescent compound can be used as the light-emitting substance which emits light having a peak in the yellow to orange wavelength range. The power efficiency in the case of using a phosphorescent compound is three to four times as high as that in the case of using a fluorescent compound. The above organometallic complex in which a pyrazine derivative serves as a ligand is a phosphorescent compound, has high emission efficiency, and easily emits light in the yellow to orange wavelength range, and thus is favorable.

For example, a pyrene diamine derivative can be used as the light-emitting substance which emits light having a peak in the blue wavelength range. A fluorescent compound can be used as the light-emitting substance which emits light having a peak in the blue wavelength range. The use of a fluorescent compound makes it possible to obtain a light-emitting element which has a longer lifetime than a light-emitting element in which a phosphorescent compound is used. The above pyrene diamine derivative is a fluorescent compound, can obtain an extremely high quantum yield, and has a long lifetime; thus, the above pyrene diamine derivative is favorable.

Figure 7C:
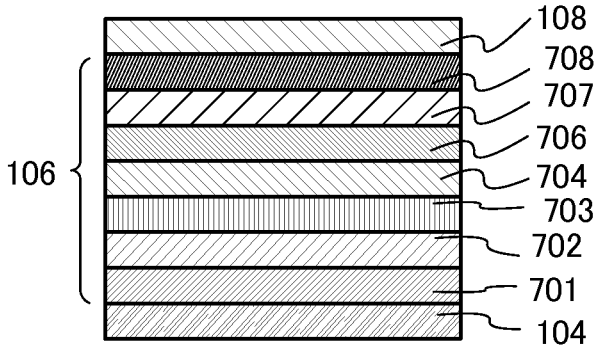

As illustrated in FIG. 7C, the EL layer may include the hole-injection layer 701, the hole-transport layer 702, the light-emitting layer 703, the electron-transport layer 704, an electron-injection buffer layer 706, an electron-relay layer 707, and a composite material layer 708 which is in contact with the second electrode 108, between the first electrode 104 and the second electrode 108.

It is preferable to provide the composite material layer 708 which is in contact with the second electrode 108, in which case damage caused to the EL layer 106 particularly when the second electrode 108 is formed by a sputtering method can be reduced. The composite material layer 708 can be formed using the above-described composite material in which an acceptor substance is mixed with an organic compound having a high hole-transport property.

Further, by providing the electron-injection buffer layer 706, an injection barrier between the composite material layer 708 and the electron-transport layer 704 can be reduced; thus, electrons generated in the composite material layer 708 can be easily injected to the electron-transport layer 704.

A substance having a high electron-injection property can be used for the electron-injection buffer layer 706: for example, an alkali metal, an alkaline earth metal, a rare earth metal, a compound of the above metal (e.g., an alkali metal compound (including oxide such as lithium oxide, a halide, or carbonate such as lithium carbonate or cesium carbonate), an alkaline earth metal compound (e.g., oxide, a halide, or carbonate), or a rare earth metal compound (e.g., oxide, a halide, or carbonate).

Further, in the case where the electron-injection buffer layer 706 contains a substance having a high electron-transport property and a donor substance, the donor substance is preferably added so that the mass ratio of the donor substance to the substance having a high electron-transport property is from 0.001:1 to 0.1:1. Note that as the donor substance, an organic compound such as tetrathianaphthacene (abbreviation: TTN), nickelocene, or decamethylnickelocene can be used as well as an alkali metal, an alkaline earth metal, a rare earth metal, a compound of the above metal (e.g., an alkali metal compound (including an oxide of lithium oxide or the like, a halide, and carbonate such as lithium carbonate or cesium carbonate), an alkaline earth metal compound (including oxide, a halide, and carbonate), and a rare earth metal compound (including oxide, a halide, and carbonate). Note that as the substance having a high electron-injection property, a material similar to the material for the electron-transport layer 704 described above can be used.

Furthermore, the electron-relay layer 707 is preferably formed between the electron-injection buffer layer 706 and the composite material layer 708. The electron-relay layer 707 is not necessarily provided; however, by providing the electron-relay layer 707 having a high electron-transport property, electrons can be rapidly transported to the electron-injection buffer layer 706.

The structure in which the electron-relay layer 707 is sandwiched between the composite material layer 708 and the electron-injection buffer layer 706 is a structure in which the acceptor substance contained in the composite material layer 708 and the donor substance contained in the electron-injection buffer layer 706 are less likely to interact with each other, and thus their functions hardly interfere with each other. Accordingly, an increase in the driving voltage can be prevented.

The electron-relay layer 707 contains a substance having a high electron-transport property and is formed so that the LUMO level of the substance having a high electron-transport property is located between the LUMO level of the acceptor substance contained in the composite material layer 708 and the LUMO level of the substance having a high electron-transport property contained in the electron-transport layer 704. In the case where the electron-relay layer 707 contains a donor substance, the donor level of the donor substance is controlled so as to be located between the LUMO level of the acceptor substance in the composite material layer 708 and the LUMO level of the substance having a high electron-transport property contained in the electron-transport layer 704. As a specific value of the energy level, the LUMO level of the substance having a high electron-transport property contained in the electron-relay layer 707 is preferably greater than or equal to −5.0 eV, more preferably greater than or equal to −5.0 eV and less than or equal to −3.0 eV.

As the substance having a high electron-transport property contained in the electron-relay layer 707, a phthalocyanine-based material or a metal complex having a metal-oxygen bond and an aromatic ligand is preferably used.

As the phthalocyanine-based material contained in the electron-relay layer 707, in particular, any of the followings is preferably used: CuPc, phthalocyanine tin(II) complex (SnPc), phthalocyanine zinc complex (ZnPc), cobalt(II) phthalocyanine, β-form (CoPc), phthalocyanine iron (FePc), and vanadyl 2,9,16,23-tetraphenoxy-29H,31H-phthalocyanine (PhO-VOPc).

As the metal complex having a metal-oxygen bond and an aromatic ligand, which is contained in the electron-relay layer 707, a metal complex having a metal-oxygen double bond is preferably used. The metal-oxygen double bond has acceptor properties (properties of easily accepting electrons); thus, electrons can be transferred (donated and accepted) more easily. Further, the metal complex which has a metal-oxygen double bond is considered stable. Thus, the use of the metal complex having the metal-oxygen double bond enables the light-emitting element to drive at low voltage more stably.

As a metal complex having a metal-oxygen bond and an aromatic ligand, a phthalocyanine-based material is preferable. Specifically, any of vanadyl phthalocyanine (VOPc), a phthalocyanine tin(IV) oxide complex (SnOPc), and a phthalocyanine titanium oxide complex (TiOPc) is preferable because a metal-oxygen double bond is likely to act on another molecular in terms of a molecular structure and an acceptor property is high.

Note that as the phthalocyanine-based materials described above, a phthalocyanine-based material having a phenoxy group is preferable. Specifically, a phthalocyanine derivative having a phenoxy group, such as PhO-VOPc, is preferable. The phthalocyanine derivative having a phenoxy group is soluble in a solvent; thus, the phthalocyanine derivative has an advantage of being easily handled during formation of a light-emitting element and an advantage of facilitating maintenance of an apparatus used for deposition.

The electron-relay layer 707 may further contain a donor substance. As the donor substance, an organic compound such as tetrathianaphthacene (abbreviation: TTN), nickelocene, or decamethylnickelocene can be used as well as an alkali metal, an alkaline earth metal, a rare earth metal, and a compound of the above metal (e.g., an alkali metal compound (including oxide such as lithium oxide, a halide, and a carbonate such as lithium carbonate or cesium carbonate), an alkaline earth metal compound (including oxide, a halide, and carbonate), and a rare earth metal compound (including oxide, a halide, and carbonate)). When such a donor substance is contained in the electron-relay layer 707, electrons can be transferred easily and the light-emitting element can be driven at lower voltage.

In the case where a donor substance is contained in the electron-relay layer 707, in addition to the materials described above as the substance having a high electron-transport property, a substance having a LUMO level greater than the acceptor level of the acceptor substance contained in the composite material layer 708 can be used. As a specific energy level, a LUMO level is greater than or equal to −5.0 eV, preferably greater than or equal to −5.0 eV and less than or equal to −3.0 eV. As examples of such a substance, a perylene derivative and a nitrogen-containing condensed aromatic compound can be given. Note that a nitrogen-containing condensed aromatic compound is preferably used for the electron-relay layer 707 because of its stability.

As specific examples of the perylene derivative, the following can be given: 3,4,9,10-perylenetetracarboxylicdianhydride (abbreviation: PTCDA), 3,4,9,10-perylenetetracarboxylic-bis-benzimidazole (abbreviation: PTCBI), N,N'-dioctyl-3,4,9,10-perylenetetracarboxylic diimide (abbreviation: PTCDI-C8H), N,N'-dihexyl-3,4,9,10-perylenetetracarboxylic diimide (abbreviation: Hex PTC), and the like.

As specific examples of the nitrogen-containing condensed aromatic compound, the following can be given: pirazino[2,3-f][1,10]phenanthroline-2,3-dicarbonitrile (abbreviation: PPDN), 2,3,6,7,10,11-hexacyano-1,4,5,8,9,12-hexaazatriphenylene ($HAT(CN)_6$), 2,3-diphenylpyrido[2,3-b]pyrazine (abbreviation: 2PYPR), 2,3-bis(4-fluorophenyl)pyrido[2,3-b]pyrazine abbreviation: (F2PYPR), and the like.

Besides, 7,7,8,8-tetracyanoquinodimethane (abbreviation: TCNQ), 1,4,5,8-naphthalenetetracarboxylicdianhydride (abbreviation: NTCDA), perfluoropentacene, copper hexadecafluoro phthalocyanine (abbreviation: $F_{16}CuPc$), N,N'-bis(2,2,3,3,4,4,5,5,6,6,7,7,8,8,8-pentadecafluorooctyl)-1,4,5,8-naphthalenetetracarboxylic diimide (abbreviation: NTCDI-C8F), 3',4'-dibutyl-5,5"-bis(dicyanomethylene)-5,5"-dihydro-2,2':5',2"-terthiophen (abbreviation: DCMT), a methanofullerene (e.g., [6,6]-phenyl $C_{61}$ butyric acid methyl ester), or the like can be used.

Note that in the case where a donor substance is contained in the electron-relay layer 707, the electron-relay layer 707 may be formed by a method such as co-deposition of the substance having a high electron-transport property and the donor substance.

The hole-injection layer 701, the hole-transport layer 702, the light-emitting layer 703, and the electron-transport layer 704 may each be formed using any of the above-described materials.

Then, the second electrode 108 is formed over the EL layer 106.

The second electrode 108 is provided on the side opposite to the side from which light is extracted and is formed using a light-reflective material. As the light-reflective material, a metal material such as aluminum, gold, platinum, silver, nickel, tungsten, chromium, molybdenum, iron, cobalt, copper, or palladium can be used. Besides, an alloy containing aluminum (an aluminum alloy) such as an alloy of aluminum and titanium, an alloy of aluminum and nickel, or an alloy of aluminum and neodymium, or an alloy containing silver such as an alloy of silver and copper can be used. The alloy of silver and copper is preferable because it has high heat resistance. Further, by stacking a metal film or a metal oxide film in contact with the aluminum alloy film, oxidation of the aluminum alloy film can be suppressed. Examples of a material for the metal film and the metal oxide film include titanium, titanium oxide, and the like. The above materials are preferable because they are present in large amounts in the Earth's crust and inexpensive to achieve a reduction in the cost of manufacturing a light-emitting element.

Note that this embodiment can be freely combined with any of the other embodiments.

Embodiment 4

In this embodiment, application examples of the lighting device will be described.

Figure 8:
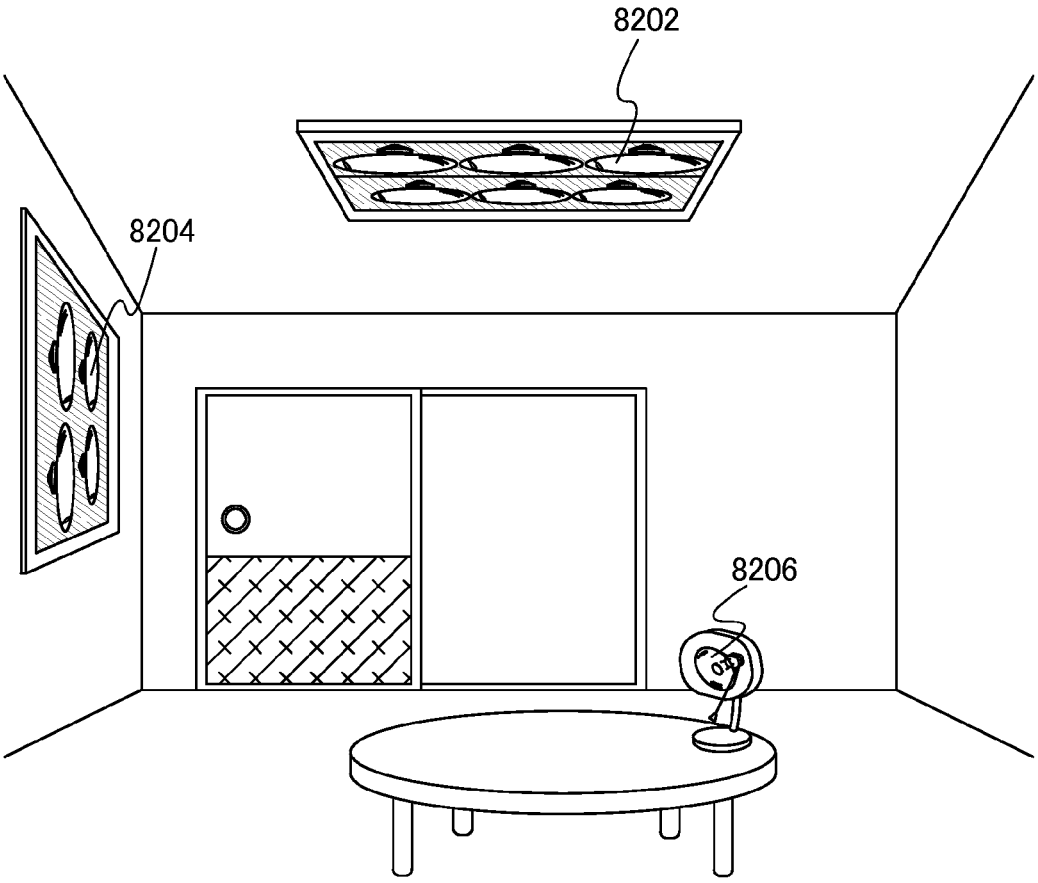
FIG. 8 illustrates an example of application of a lighting device.

FIG. 8 illustrates an example in which the lighting device of one embodiment of the present invention is used as an indoor lighting device. The lighting device of one embodiment of the present invention can be used not only as a ceiling-mounted lighting device 8202, but also as a wall-mounted lighting device 8204. The lighting device can also be used as a desk lighting device 8206. Since the lighting device of one embodiment of the present invention has a planar light source, it has advantages such as a reduction in the number of components like a light-reflecting plate as compared with the case of using a point light source, or less heat generation as compared with a filament bulb, and is preferably used as an indoor lighting device.

Next, examples in which the lighting device that is one embodiment of the present invention is applied to a lighting device such as traffic lights or guide lights are illustrated in FIGS. 9A to 9D.

Figure 9A:
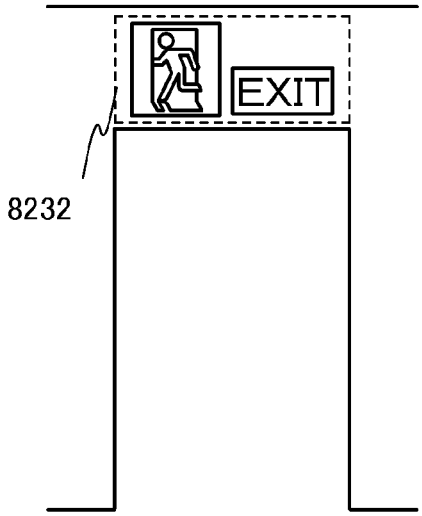
FIGS. 9A to 9D each illustrate an example of application of a lighting device.

FIG. 9A illustrates an example in which the lighting device that is one embodiment of the present invention is applied to an emergency exit light.

For example, FIG. 9A is an external view of an emergency exit light. An emergency exit light 8232 can be formed by combination of a lighting device and a fluorescent plate provided with a fluorescent portion. The emergency exit light 8232 can also be formed by combination of a lighting device emitting a specific light and a light-shielding plate provided with a transmitting portion having a shape illustrated in the drawing. The lighting device that is one embodiment of the present invention can emit light with a constant luminance, and thus is preferably used as an emergency exit light that needs to be on at all times.

Figure 9B:
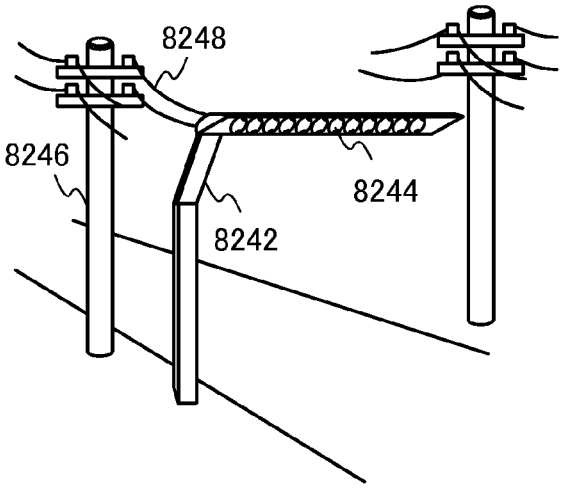

An example in which the lighting device that is one embodiment of the present invention is applied to an outdoor light is illustrated in FIG. 9B.

An example of the outdoor light is a streetlight. A streetlight can be formed by, for example, a housing 8242 and a lighting portion 8244 as illustrated in FIG. 9B. A plurality of lighting devices of one embodiment of the present invention can be arranged in the lighting portion 8244. As illustrated in FIG. 9B, for example, the streetlight stands by the side of a road so that the lighting portion 8244 can illuminate the surroundings, whereby the visibility of the road and its surroundings can be improved.

In the case where a power supply voltage is supplied to the streetlight, for example, it can be supplied through a power line 8248 on a utility pole 8246 as illustrated in FIG. 9B. Note that the present invention is not limited to this case; for example, a photoelectric converter may be provided in the housing 8242 so that a voltage obtained from the photoelectric converter can be used as a power supply voltage.

Figure 9C:
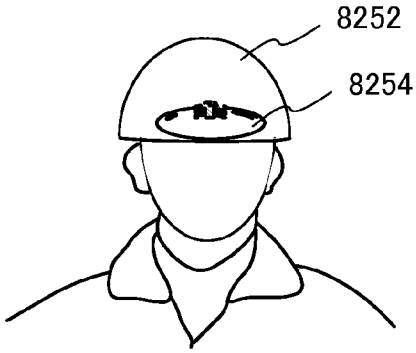
Figure 9D:
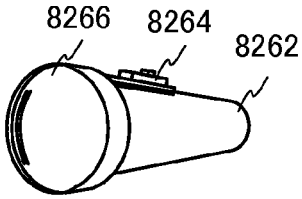

Examples in which the lighting device that is one embodiment of the present invention is applied to a portable light are illustrated in FIGS. 9C and 9D. FIG. 9C illustrates a structure of a wearable light and FIG. 9D illustrates a structure of a handheld light.

The wearable light illustrated in FIG. 9C includes a mounting portion 8252 and a lighting portion 8254 fixed to the mounting portion 8252. The lighting device that is one embodiment of the present invention can be used for the lighting portion 8254. The mounting portion 8252 of the wearable light illustrated in FIG. 9C can be attached to the head, and the lighting portion 8254 can emit light. When a planar light source is used for the lighting portion 8254, the visibility of the surroundings can be improved. In addition, the lighting portion 8254 is lightweight, which makes it possible to reduce the load on the head on which the light is mounted.

Note that the structure of the wearable light is not limited to that illustrated in FIG. 9C, and for example, the following structure can be employed: the mounting portion 8252 is formed as a ring belt of flat braid or elastic braid, the lighting portion 8254 is fixed to the belt, and the belt is directly tied around the head.

The handheld light illustrated in FIG. 9D includes a housing 8262, a lighting portion 8266, and a switch 8264. The lighting device that is one embodiment of the present invention can be used for the lighting portion 8266. The use of the lighting device that is one embodiment of the present invention reduces the thickness of the lighting portion 8266 and thus reduces the size of the light, which makes it easy for the light to be carried around.

The switch 8264 has a function of controlling emission or non-emission of the lighting portion 8266. The switch 8264 can also have a function of controlling, for example, the luminance of the lighting portion 8266 during light emission.

In the handheld light illustrated in FIG. 9D, the lighting portion 8266 is turned on with the switch 8264 so as to illuminate the surroundings, whereby the visibility of the surroundings can be improved. Furthermore, since the lighting device that is one embodiment of the present invention has a planar light source, the number of components like a light-reflecting plate can be reduced as compared with the case of using a point light source.

What is described in this embodiment with reference to each drawing can be freely combined with or replaced with what is described in other embodiments as appropriate.

This application is based on Japanese Patent Application serial no. 2010-227849 filed with Japan Patent Office on Oct. 7, 2010, the entire contents of which are hereby incorporated by reference.

What is claimed is:

1. A lighting device comprising:

a light-emitting element including an EL layer sandwiched between a first electrode and a second electrode; and a housing that covers a light emission surface and is formed using a light-transmitting organic resin whose refractive index is greater than or equal to a refractive index of the EL layer, wherein at least one of the first electrode and the second electrode has a light-transmitting property.

2. The lighting device according to claim 1, further comprising an inorganic insulating film covering an inner wall of the housing and a top surface of the light-emitting element.

3. The lighting device according to claim 1, wherein the housing that covers the light emission surface has a projection and a depression.

4. The lighting device according to claim 1, wherein the refractive index of the light-transmitting organic resin is greater than or equal to 1.7 and less than or equal to 1.8.

5. The lighting device according to claim 1, wherein the EL layer has two or more layers with an intermediate layer provided therebetween.

6. A lighting device comprising:

a light-emitting element including an EL layer sandwiched between a first electrode and a second electrode;

a first housing covering a light emission surface of the light-emitting element; and a second housing covering a top surface of the light-emitting element, wherein at least one of the first electrode and the second electrode has a light-transmitting property, wherein the first housing is formed using a light-transmitting organic resin whose refractive index is greater than or equal to a refractive index of the EL layer, and wherein the first housing and the second housing are attached to each other to seal the light-emitting element.

7. The lighting device according to claim 6, further comprising an inorganic insulating film covering an inner wall of the second housing and the top surface of the light-emitting element.

8. The lighting device according to claim 6, wherein the first housing has a projection and a depression.

9. The lighting device according to claim 6, wherein the refractive index of the light-transmitting organic resin is greater than or equal to 1.7 and less than or equal to 1.8.

10. The lighting device according to claim 6, wherein the EL layer has two or more layers with an intermediate layer provided therebetween.

* * * * *